US005744745A

United States Patent [19]

Shim et al.

[11] Patent Number: 5,744,745

[45] Date of Patent: Apr. 28, 1998

[54] MISSILE DETENT AND RELEASE APPARATUS

[75] Inventors: Woo-Jeon Shim; Bon-Soon Koo; Beom-Soo Lim; Kil-Ho Hong, all of Daejon, Rep. of Korea

[73] Assignee: Agency for Defense Development, Rep. of Korea

[21] Appl. No.: 764,523

[22] Filed: Dec. 12, 1996

[30] Foreign Application Priority Data

Dec. 15, 1995 [KR] Rep. of Korea ..... 50631/1995

[51] Int. Cl.[6] ..... F41F 3/04

[52] U.S. Cl. ..... 89/1.806; 89/1.812

[58] Field of Search ..... 89/1.806, 1.812, 89/1.807, 1.808, 1.8; 114/238

[56] References Cited

U.S. PATENT DOCUMENTS

| | | | |
|---|---|---|---|
| 2,879,677 | 1/1959 | Herrmann | 89/1.806 |
| 3,296,929 | 1/1967 | Jacobson | 89/1.806 |
| 3,398,639 | 8/1968 | Apotheloz | 89/1.806 |
| 3,825,980 | 7/1974 | Moore | 114/238 |
| 4,453,449 | 6/1984 | Hollmann | 89/1.806 |
| 4,550,640 | 11/1985 | Harter | 89/1.806 |
| 5,056,407 | 10/1991 | Mathey | 89/1.806 |

*Primary Examiner*—Michael J. Carone
*Assistant Examiner*—Theresa M. Wesson
*Attorney, Agent, or Firm*—Scully, Scott, Murphy & Presser

[57] ABSTRACT

A missile detent and release apparatus which is capable of detaining and rapidly releasing a missile in a launch tube when conveying/launching the same, and in particular to an improved missile detent and release apparatus by which the missile is easily detained and rapidly released with only a small amount of force, and by which the missile can be stably detained in the launch tube conveying the missile, which includes a pair of detaining protrusions protruded from one end portion of a missile, a pair of fixing members fixed on an inner surface of a missile launch tube and having a detaining groove into which the detaining protrusion is inserted, with the fixing members being formed in the forwarding direction of the missile, a detaining screw passing through a detaining groove of each fixing member in the forwarding direction of the missile and engaged to a detaining screw hole formed at the center portion of the detaining protrusion for detaining the missile in the forwarding direction of the missile, a releasing rotation member rotatably engaged to the fixing member, and extending in the direction of the center of a missile nozzle, with the releasing rotation member being backwardly moved by a rocketing force of the missile, and a detaining pin for detaining the movement of the detaining screw, with the end portion thereof being fixed to the rotation member.

11 Claims, 5 Drawing Sheets

MISSILE DETENT AND RELEASE APPARATUS

BACKGROUND OF THE INVENTION

1. Field of the Invention

The present invention relates to a missile detent and release apparatus for a tube-launched missile capable of detaining and rapidly releasing a missile in a launch tube when conveying/launching the same, and in particular to an improved missile detent and release apparatus by which the missile is easily detained and rapidly released with only a small amount of force, and by which the missile can be stably detained in the launch tube conveying the missile.

2. Description of the Conventional Art

Generally, when conveying a missile, the missile is moved, with the missile being contained in a missile launch tube for protection from external impact. In this case, it is very important to stably secure the missile in the missile launch tube. When handling/conveying the missile, the missile should be stably and safely secured in the missile launch tube. In addition, when launching the missile, the missile should be rapidly unlocked from the missile launch tube, so that the missile can be rapidly and accurately launched, thus enhancing the reliability of the missile system.

For meeting the above-mentioned objectives, various types of missile detent apparatuses have been introduced in the industry. For example, it is known to use a small explosive change for releasing the missile from the missile launch tube by exploding an explosive bolt just before launching the missile. In addition, it is known to use a tension bolt or shearing bolt, which is cut by the thrust of the missile.

In the case of the above-mentioned methods, there are advantages in that it is possible to easily detain and rapidly release the missile from the missile launch tube, without applying a large amount of the explosion force to the missile and the launch tube; however when exploding the explosive in the missile tube the internal system of the missile may be damaged by the explosion force applied thereto. In addition, the explosion method has another disadvantage in that the system should be additionally equipped with a device for checking whether the missile is launched in a state that the explosive is not exploded.

In addition, in the case of the above-mentioned method of using a tension bolt or a shearing bolt, since the tension bolt or a shearing bolt receives a rocketing force caused by the rocketing material just after it is fired, in the case of a small size missile, a tension and shearing bolt having a small tension force should be used, so that the bolt may be easily sheared or broken due to a force applied thereto when conveying the missile, for thus degrading the reliability of the system.

In order to prevent the above-mentioned problems, when a bigger bolt is used in order to prevent the bolt from being sheared, and a greater force is applied thereto, with the missile being applied with a greater force, the missile launch may be vibrated by the greater force, thus causing an inaccurate launching of the missile. In addition, the tension bolt and the shearing bolt should be made to have an uniform strength, so that a very accurate process and test is necessary.

Moreover, the conventional methods may cause an erroneous launch of the missile due to the above-mentioned problems.

SUMMARY OF THE INVENTION

Accordingly, it is an object of the present invention to provide an improved missile detent and release apparatus which overcomes the problems encountered in the conventional missile detent and release apparatus.

It is another object of the present invention to provide a missile detent and release apparatus which is capable of detaining and rapidly releasing a missile in a launch tube when conveying/launching the same, and in particular to an improved missile detent and release apparatus by which the missile is easily detained and rapidly released with only a small amount of force, and by which the missile can be stably detained in the launch tube conveying the missile.

To achieve the above objects, there is provided a missile detent and release apparatus, which includes a pair of detaining protrusions protruded from one end portion of a missile, a pair of fixing members fixed on an inner surface of a missile launch tube and having a detaining groove into which the detaining protrusion is inserted, with the fixing members being formed in the forwarding direction of the missile, a detaining screw passing through a detaining groove of each fixing member in the forwarding direction of the missile and engaged to a detaining screw hole formed at the center portion of the detaining protrusion for detaining the missile in the forwarding direction of the missile, a releasing rotation member rotatably engaged to the fixing member, and extending in the direction of the center of a missile nozzle, with the releasing rotation member being backwardly moved by a rocketing force of the missile, and a detaining pin for detaining the movement of the detaining screw, with the end portion thereof being fixed to the rotation member.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 4A and 4B are cross-sectional views illustrating an operation state of a missile detent and release apparatus according to the present invention, of which:

FIG. 4A is a cross-sectional view showing a state that a missile is loaded in a launch tube and detained therein before the missile is launched; and FIG. 4B is a cross-sectional view showing a missile and a launch tube after a missile is launched in the present invention;

DETAILED DESCRIPTION OF THE INVENTION

A missile detent and release apparatus according to a preferred embodiment of the present invention will now be described with reference to the accompanying drawings.

Figure 1:
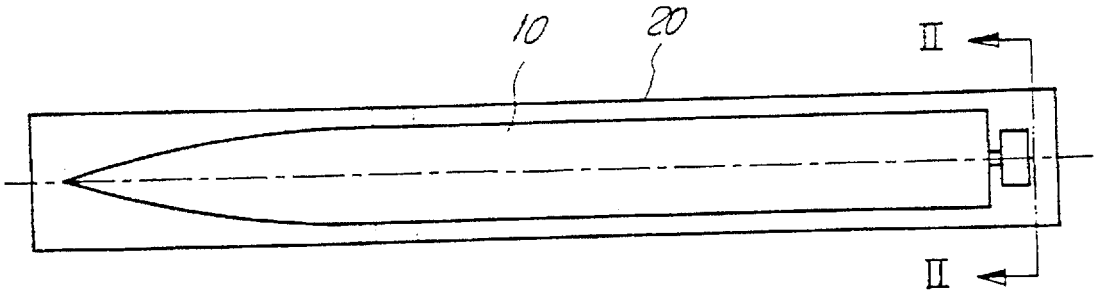
FIG. 1 is a schematic cross-sectional view illustrating a missile and a launch tube according to the present invention is adapted.

FIG. 1 is a schematic cross-sectional view illustrating a missile and a launch tube according to the present invention. In the drawings, reference numeral 10 denotes a missile, and reference numeral 20 denotes a missile launch tube. Here, the missile 10 is detained in the missile launch tube 20 by a detaining member.

Figure 2:
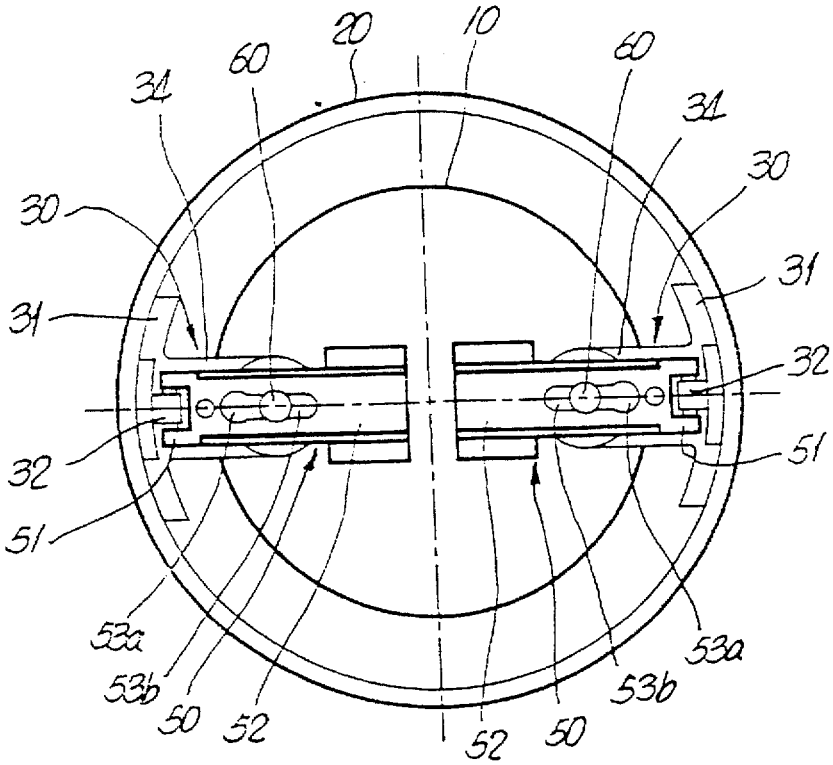
FIG. 2 is a cross-sectional view taken along the line II—II of FIG. 1 according to the present invention.
Figure 3:
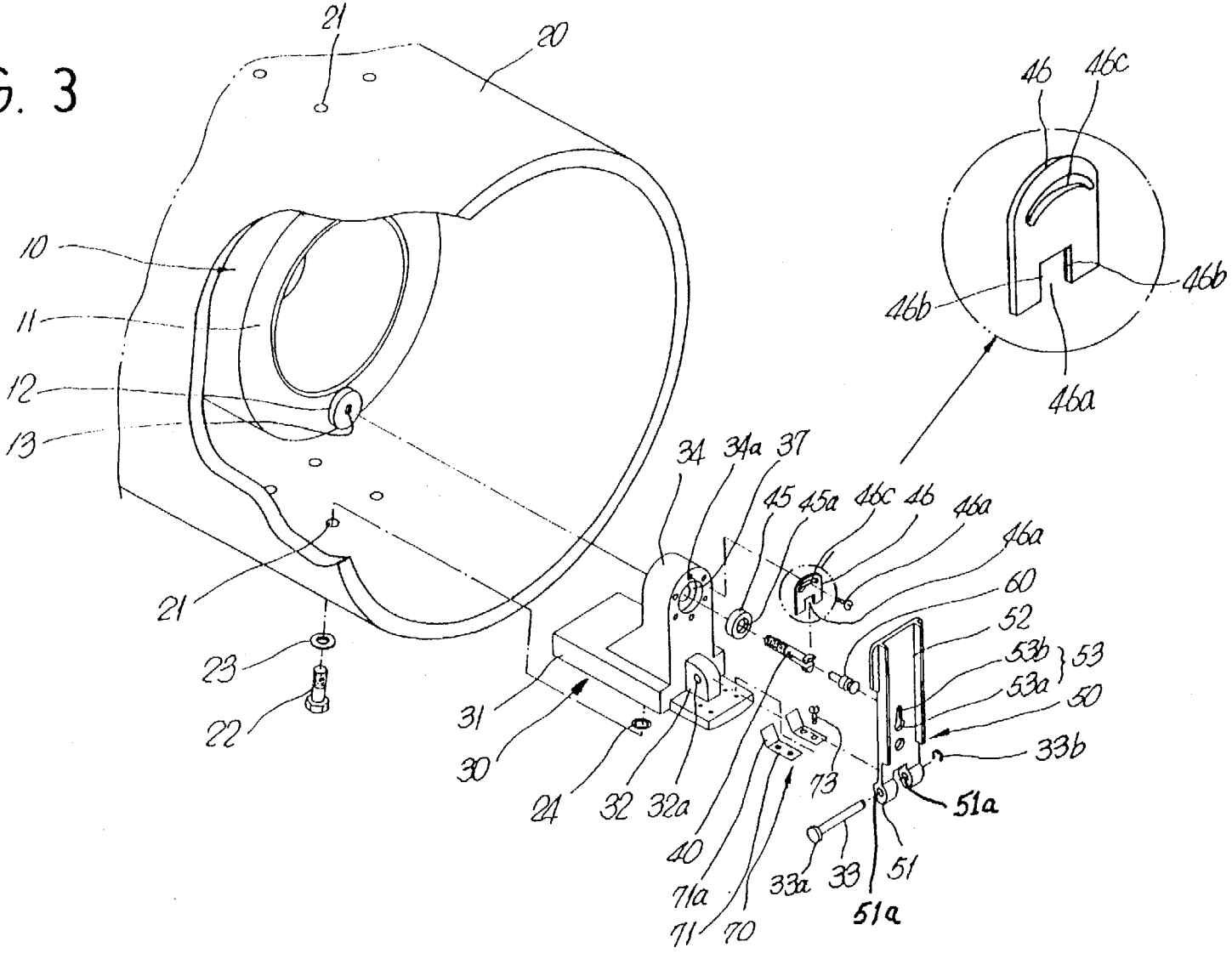
FIG. 3 is an exploded perspective view illustrating a missile detent and release apparatus according to the present invention.

As shown in FIGS. 2 through 4, the missile 10 is encapsulated within the missile launch tube 20, with a missile nozzle of the same being fixed by the detaining. In addition, as shown in FIG. 3, a pair of circular-shaped detaining protrusions 12 are formed in the end portion of a missile nozzle 11, and a detaining screw hole 13 is formed in the center portion of each of the detaining protrusions 12.

As shown in FIG. 1, the missile launch tube 20 is hollow-shaped and has a larger inner diameter than the outer diameter of the missile 10, and a plurality of screw through holes 21 are formed in the outer wall so as to fix the detaining member, with a plurality of fixing screws 22 passing through the screw through holes 21.

The detaining member, as shown in FIGS. 2 through 4, is fixed to both inner sides of the end portion of the missile launch tube 20. The detaining member includes a pair of fixing members 30 having a detaining groove 35 and a through hole 36 which are coaxially formed therein and communicate with the detaining protrusions 12, a pair of detaining screws 40 screwed to the center portion of the detaining protrusions 12 formed in the missile nozzle 11 of the missile 10 passing through the center portion of the detaining groove 35 and the through hole 36 of the fixing member 30, and having an engaging head portion 44 formed in the end portion thereof, a pair of releasing rotation members 50 rotatably supported by the fixing member 30, and driven by a combustion gas projected from a rocket motor of the missile, with the end portion thereof extending from the center portion of the missile nozzle 11, and a pair of detaining pins 60 inserted into the engaging head portion 44 of the detaining screw 40 in a state that the end portion thereof is fixed to the releasing rotation member 50.

As shown in FIGS. 3 and 5, the fixing member 30 includes a fixing portion 31 closely attached and fixed to the inner surface of the missile launch tube 20, and a support portion 34 extended in the direction of the center portion of the missile launch tube 20 from the fixing portion 31 and having a detaining groove 35 and the through hole 36.

The fixing portion 31 is fixed by engaging the fixing screw 22 passing through the screw through hole 21 formed in the wall of the missile launch tube 20 to the screw groove **31*a* formed in the outer surface thereof. When engaging the fixing screw 22, a washer 23 and an O-ring 24 are inserted between the outer surface of the missile launch tube 20 and the fixing screw 22, so that a tight sealing is achieved in the screw through hole 21 through which the fixing screw 22** passes.

Here, the screw groove **31*a* is opened at the outer portion of the fixing portion 31 and is closed at the inner portion thereof, so that a tight sealing is achieved in the screw through hole 21, for thus effectively sealing the entire portions of the missile launch tube 20**.

A hinge portion 32 is formed in the end portion of the fixing portion 31 for rotatably supporting the releasing rotation member 50.

A hinge hole **32*a*, through which a hinge pin 33 passes, is formed in the hinge portion 32 formed in the end portion of the fixing portion 31 so as to rotatably support the releasing rotation member 50**.

The through hole 36 is coaxially formed with respect to the detaining groove 35 in the support portion 34, and a washer insertion groove 37, into which a taper washer 45 having a taper hole **45*a* is inserted, which the diameter thereof is reduced toward the front portion thereof, is formed in the end portion thereof. The diameter of the through hole 36 is smaller than that of the detaining groove 35 and is greater than the outer diameter of the detaining screw 40. The washer insertion groove 37 has a larger diameter than that of the through hole 36, and a recess is formed between the washer insertion groove 37 and the through hole 36**.

Figure 5A:
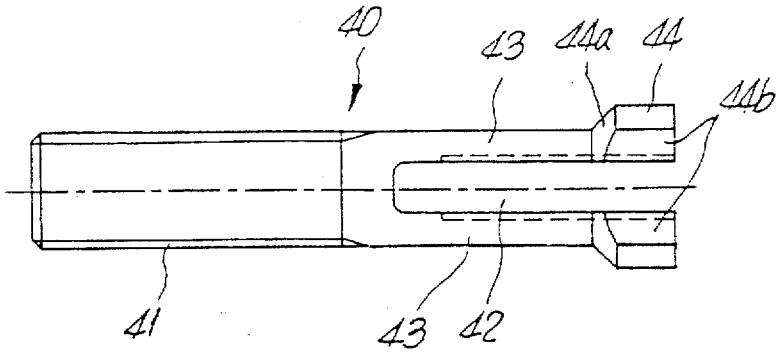
FIGS. 5A and 5B are an enlarged front view and a side view of a split-head bolt according to the present invention.
Figure 5B:
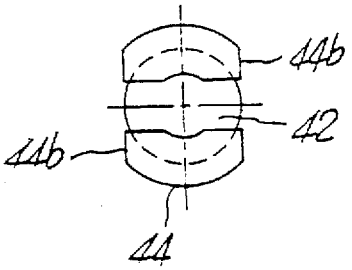
Figure 6:
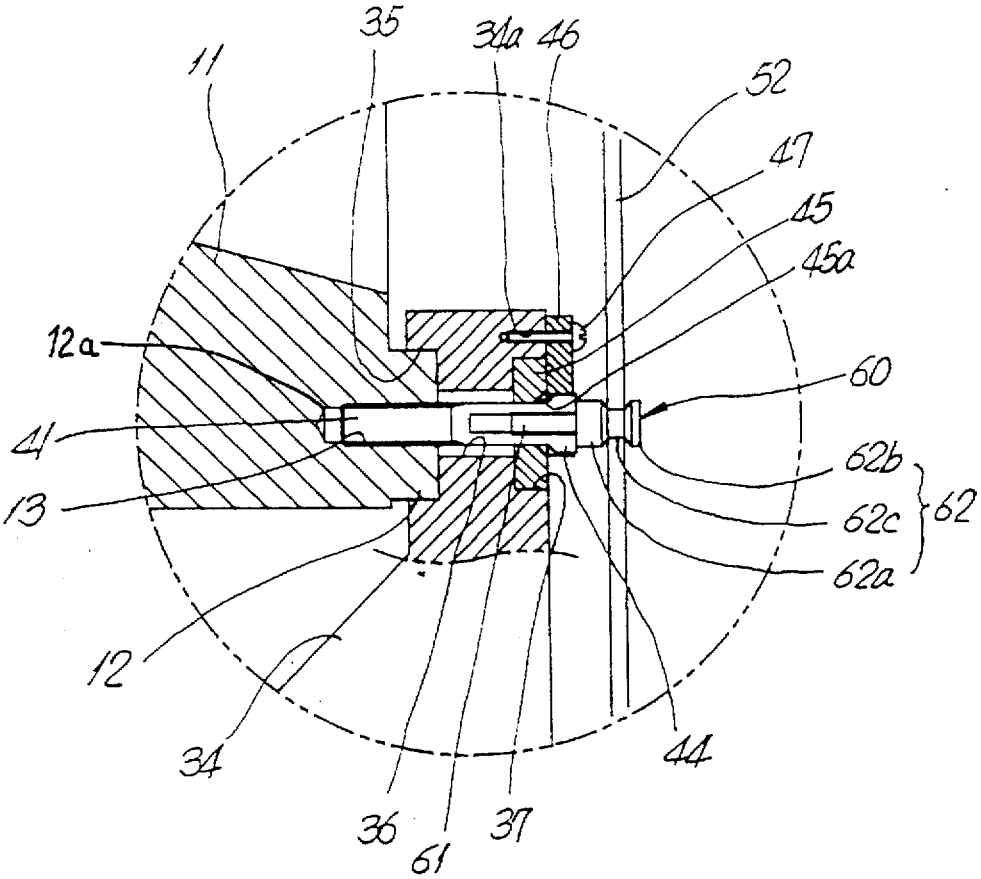
FIG. 6 is an enlarged view showing the portion "B" of FIG. 4A according to the present invention.

As shown in FIGS. 5A, 5B, and 6, the detaining screw 40 includes a screw portion 41 engaged to a detaining screw hole **12*a* formed in the center portion of the detaining protrusion 12 of the missile 10, a pair of elastic members 43 formed in cooperation with the cut-away groove 42 in the end portion of the screw portion 41, and the engaging head portion 44 formed in the end portion of the elastic members 43**.

A slant guide surface **44*a* is formed between the engaging head portion 44 and the elastic members 43, with the diameter thereof being reduced toward the front portion of the engaging head portion 44**.

The detaining screw 40 passes through a taper hole **45*a* of a taper washer 45 inserted into the washer insertion groove 37 formed in the rear surface of the support portion 34 of the fixing member 30, and the slant guide surface 44*a* and the taper surface of the taper hole 45*a*** face each other.

In addition, a flat surface portion **44*b* is formed in both surfaces of the engaging head portion 44 so as to prevent the detaining screw 40 from being escaped from the detaining protrusion 12 formed in the end portion of the missile 10, and a releasing prevention plate 46 having a releasing prevention groove 46*a* having a straight line portion 46*b* coinciding with both surfaces of the flat surface portion 44*b* is formed in the rear surface of the support portion 34 of the fixing member 30**.

As shown in FIGS. 3 and 6, the releasing prevention plate 46 is engaged to the rear surface of the support portion 34 of the fixing member 30 by a fixing screw 47, and a plurality of screw holes **34*a*, into which the fixing screws are engaged, coaxially arranged with respect to the detaining groove 35 in the rear surface of the support portion 34. In addition, a circular-shaped elongated hole 46*c* is formed in the releasing prevention plate 46, with the elongating hole 46*c* being coaxial with respect to the detaining groove 35, so that the straight line portion of the releasing prevention plate 46 and the flat surface portion 44*b* always face with each other when the position of the flat surface portion 44*b* of the engaging head portion 44 varies based on the engaging state of the detaining screw 40 when the fixing screw is engaged to the screw hole through the circular-shaped elongated hole 46*c***.

As shown in FIG. 3, the releasing rotation member 50 includes a hinge portion 51 mating with the hinge portion 32 of the fixing member 30, and an operating plate portion 52 extending toward the center portion of the missile launch tube 20 from the hinge portion 51.

The releasing rotation member 50 becomes forwardly and rearwardly rotatable with respect to the fixing member 30 by inserting the hinge pin 33 into the hinge hole **51*a*, with the hinge pin 33 also passing through the hinge hole 32*a* of the hinge portion 32**.

The hinge pin 33 includes a head portion **33*a* having a predetermined size, which does not pass through the hinge hole 51*a*, and formed in one end thereof, with the other end thereof being inserted by a releasing prevention ring 33*b* so as to prevent an escape from the hinge hole 51*a***.

A detaining pin fixing hole 53 is formed in the intermediate portion of the operating plate portion 52, into which the detaining pin 60 inserted into the cut-away groove 42 of the detaining screw 40 is inserted.

The detaining pin fixing hole 53 is shaped like a key hole in cooperation with a fixing portion 53*b* having a smaller width than the inner diameter of an entrance portion 53*a*.

As shown in FIGS. 3, 4A, 4B, and 6, the detaining pin 60 includes a pin portion 61 inserted into the cut-away groove 42, and a fixing head portion 62 fixed to the releasing rotation member 50 and formed in the end portion of the pin portion 61.

The fixing head portion 62 includes a pair of fixing protrusions 62*a* and 62*b* spaced apart from the end portion thereof, and a fixing groove 62*c* formed between the fixing protrusions 62*a* and 62*b*. The fixing head portion 62 is introduced through the entrance portion 53*a* having the detaining pin fixing hole 53 of the releasing rotation member 50 and is moved to the fixing portion 53*b*, and the fixing groove 62*c* is engaged to both sides of the fixing portion 53*b*.

The releasing rotation member 50 is perpendicular with respect to the axial line of the missile 10 in a state that the missile 10 is detained by a rotation member detaining member 70, and after the releasing rotation member 50 is moved backwardly by the combustion gas at the moment when the missile is launched, the backwardly moved state is maintained by the rotation member detaining member 70.

Figure 4A:
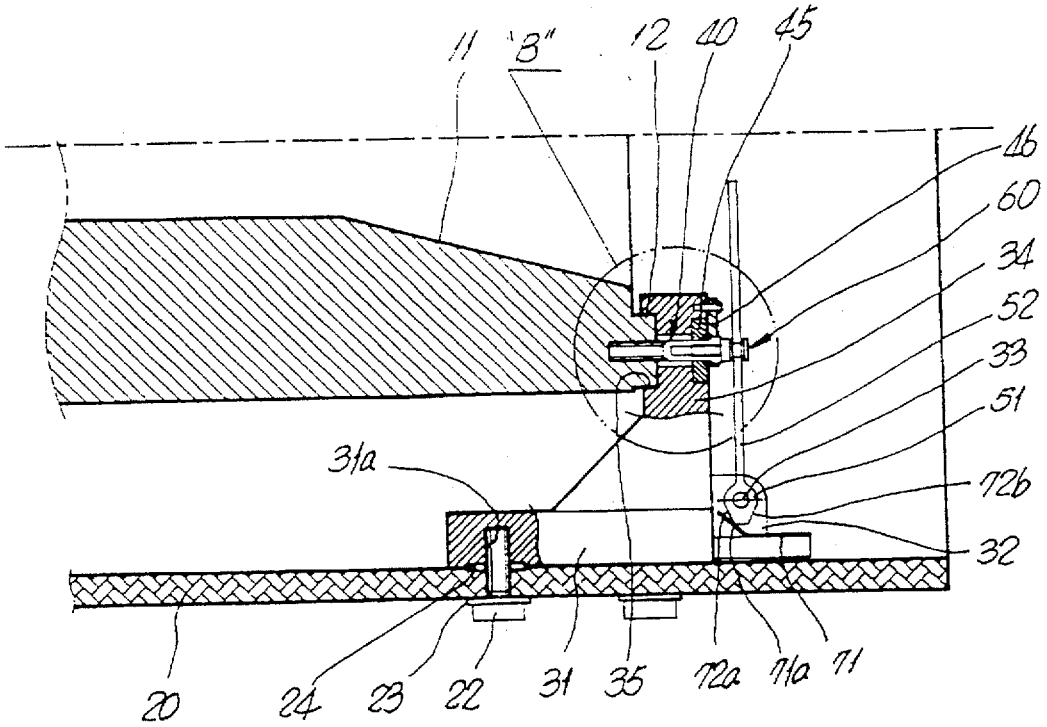
Figure 4B:
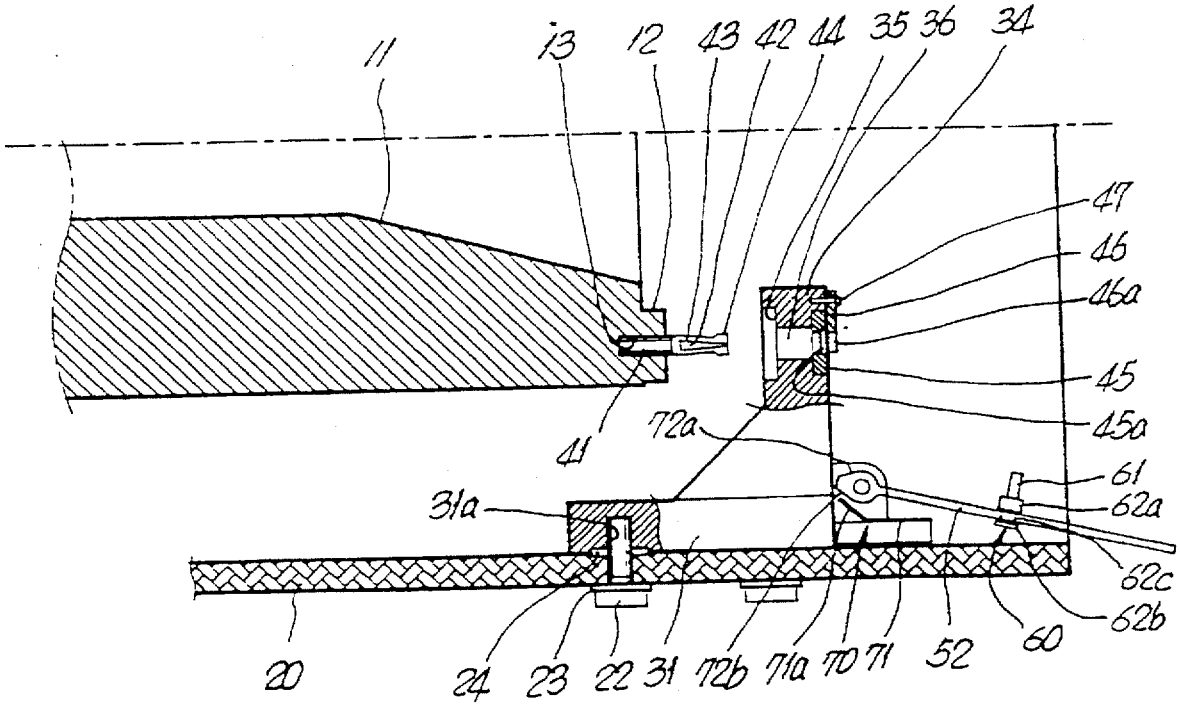

As shown in FIGS. 3 and 4B, the rotation member detaining member 70 includes an elastic plate 71 fixed to the upper surface of the fixing portion 31 and having a curved elastic contact portion 71*a*, and detaining surfaces 72*a* and 72*b* formed at outer surfaces of the hinge portion 51 of the releasing rotation member 50 and selectively coming into contact with the elastic contact portion 71*a*. With the above-mentioned construction, in a state that the missile 10 is detained, the elastic contact portion 71*a* contacts with the front side of the detaining surface 72*a* so as to prevent the releasing rotation member 50 from being rotated, and in a state that the missile 10 is launched and released, the elastic contact portion 71*a* contacts with the rear side of the detaining surface 72*b* in order for the releasing rotation member 50, which is moved to the rear side, not to be returned by the repulsive force.

In the drawings, reference numeral 73 denotes a fixing screw for fixing the elastic plate 71 to the fixing portion 31 of the fixing member 30.

When assembling the missile detent and releasing apparatus according to the present invention, the taper washer 45 is inserted into the washer insertion groove 37 of the support portion 34 of the fixing member 30, and the releasing rotation member 50 is hinged to the hinge portion 32.

Here, when hinging the releasing rotation member 50 to the hinge portion 32, the head portion 33*a* formed at one end of the hinge pin 33 is engaged to the hinge portion 51 by inserting the hinge pin 33 into the hinge hole 32*a* of the hinge portion 32 and the hinge hole 51*a* formed in the hinge portion 51 of the releasing rotation member 50, respectively, and the releasing prevention ring 33*b* is inserted to the other end of the hinge pin 33 in order for the hinge pin 33 not to be escaped from the hinge holes 32*a* and 51*a*.

The fixing portion 31 of the fixing member 30, to which the releasing rotation member 50 is hinged, is inserted to the inner surface of the end portion of the missile launch tube 20, and the screw groove 31*a* formed in the fixing portion 31 of the fixing member 30 and the screw through hole 21 of the missile launch tube 20 coincide with each other, and the washer 23 is inserted onto the outer surface of the missile launch tube 20, and the O-ring 24 is inserted between the fixing portion 31 and the inner surface of the missile launch tube 20, and the fixing screw 22 passes through the screw through hole 21 and is engaged to the screw groove 31*a*, so that the fixing member 30 is fixed to the inner portion of the missile launch tube 20.

Here, since the screw groove 31*a* of the fixing portion 31 has a closed portion at its bottom, and the O-ring 24 surrounding the screw groove 31*a* and the screw through hole 21 is inserted between the fixing portion 31 and the missile launch tube 20, it is possible to obtain a tight sealing at the periphery of the screw through hole 21.

In this state, the detaining protrusion 12 of the missile 10 is inserted into the detaining groove 35 formed in the support portion 34 of the fixing member 30, and the detaining screw 40 is inserted into to the taper hole 45*a* of the taper washer 45, the through hole 36, and the detaining groove 35. Thereafter, the detaining protrusion 12 thereof is engaged to the detaining screw hole 13 formed in the center portion of the detaining protrusion 12.

Here, the releasing prevention plate 46 is engaged to the rear portion of the support portion 34 using the fixing screw 47, and the straight line portion 46*b* of the releasing prevention groove 46*a* coincides with the flat surface portion 44*b* of the engaging head portion 44, thus preventing the detaining screw 40 from being released. Here, when engaging the detaining screw 40, since the flat surface portion 44*b* of the engaging head portion 44 is not always in the same position, it is possible to stably and accurately prevent the releasing of the detaining screw 40 even when the flat surface portion 44*b* of the engaging head portion 44 is in any position by engaging the screws to the plurality of the screw holes 34*a* formed in the rear surface of the support portion 34 through the circular-shaped elongated hole 46*c* formed in the releasing prevention plate 46 in a state that the straight line portion 46*b* of the releasing prevention plate 46 coincides with the flat surface portion 44*b* of the engaging head portion 44 in a state that the detaining screw 40 is engaged.

Next, the fixing head portion 62 of the detaining pin 60 is introduced into the entrance portion 53*a* of the detaining pin fixing hole 53 formed in the operating plate portion 52 of the releasing rotation member 50 in a state that the fixing groove 62*c* formed between the fixing protrusions 62*a* and 62*b* is engaged to both sides of the fixing portion 53*b* of the detaining pin fixing hole 53, so that the detaining pin 60 is not moved in the direction of the forwarding missile.

The detaining of the missile in the missile launch tube 20 is completed by inserting the pin portion 61 of the detaining pin 60 into the cut-away groove 42 of the detaining screw 40 by rotating the releasing rotation member 50 to which the detaining pin 60 is engaged.

Here, in a state that the detaining of the missile 10 is finished, the elastic contact portion 71*a* of the elastic plate 71 is engaged to the detaining surface 72*a* formed in the hinge portion 51 of the releasing rotation member 50, for thus preventing the releasing rotation member 50 from being rotated.

Since the above-mentioned assembly processes are performed from the rear side of the missile launch tube, it is very easy and convenient to perform the assembly processes.

In the above-mentioned state, as shown in FIG. 4A, since the detaining protrusion 12 of the missile nozzle 11 is inserted in the detaining groove 35 formed in the support portion 34 of the pair of the fixing members 30, the detaining in the radial direction is stably secured. In addition, the detaining screw 40 is screwed to the detaining protrusion 12. Since the pin portion 61 of the detaining pin 60 engaged to the releasing rotation member 50 is inserted into the cut-away groove 42 in a state that the detaining screw 40 backwardly passes through the taper hole 45*a* of the taper washer 45 inserted into the detaining groove 35 of the support portion 34, the through hole 36, and the washer insertion groove 37, the detaining of the missile 10 is stably secured.

In the above-mentioned state, when the missile 10 is launched, the initial rocketing force is applied to the operating plate portion 52 of the releasing rotation member 50. At this time, when the rocketing force exceeds a predetermined level, the operating plate portion 52, as shown in FIG. 4B, moves backwardly, and the detaining pin 60, the fixing head portion 62 of which is fixed to the detaining pin fixing hole 53 of the operating plate portion 52, is escaped from the detaining pin 60. Thereafter, the rocketing force of the missile 10 is not applied to the taper slant guide surface 44*a* of the engaging head portion 44 of the detaining screw 40. This force serves to reduce the range of the elastic members 43 in which the detaining pin 60 is escaped from the cut-away groove 42 in cooperation with the taper slant guide surface 44*a* and the taper hole 45*a*, and the outer diameter of the engaging head portion 44 is reduced more than the inner diameter of the taper hole 45*a* of the taper washer 45, and the detained missile 10 is released, and the missile 10 is launched from the missile launch tube 20 by rocketing force, with the engaging head portion 44 being escaped from the taper hole 45*a* of the taper washer 45, the through hole 36, and the detaining groove 35.

Meanwhile, the releasing rotation member 50 which is backwardly moved by the rocketing force of the missile 10, as shown in FIG. 4B, is not returned by the repulsive force as the elastic contact portion 71*a* of the elastic plate 71 is engaged to the detaining surface 72*b* formed in the hinge portion 51, and the detaining pin 60 engaged to the releasing rotation member 50 is not inserted into the cut-away groove 42 of the detaining pin 60, so that the releasing operation is accurately performed.

As described above, the missile detent and release apparatus according to the present invention is directed to accurately detaining the missile in the missile launch tube when conveying the same, and releasing the missile when launching the same, for thus enhancing an accurate missile launch performance and significantly reducing missile launch error. In addition, when assembling the missile to the missile launch tube so as to detain the missile in the missile launch tube, the assembling is performed from the rear portion of the system in order, for thus facilitating an easier assembling of the missile system.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A missile detent and release apparatus, comprising:

a pair of detaining protrusions protruding from one end portion of a missile;

a pair of fixing members fixed on an inner surface of a missile launch tube and each having a detaining groove into which respectively one of the detaining protrusions is inserted, with the fixing members each having hinge portions and being formed to extend in a direction coaxial with the longitudinal axis of the missile:

a detaining screw passing through a detaining groove of each one of said fixing members in the direction of the longitudinal axis the missile and engaged into a detaining screw hole formed at the center portion of the detaining screw hole formed at the center portion of the detaining protrusion for detaining the missile coaxially with the longitudinal axis of the missile;

a releasing rotation member rotatably engaged with each of said fixing members, and extending coaxially with the longitudinal axis of a missile nozzle, with the releasing rotation member being backwardly moved by a rocketing force of the missile; and a detaining pin for detaining the movement of the detaining screw, with the end portion thereof being fixed to the rotation member.

2. The apparatus of claim 1, wherein each of said fixing members includes:

a fixing portion having a screw groove coinciding with a screw through hole formed in the wall of the missile launch tube;

a support portion integrally formed with the fixing portion and extending coaxially with the longitudinal axis of the missile, with the support portion having a detaining groove; and said hinge portions having the releasing rotation member hinged thereto.

3. The apparatus of claim 2, wherein said screw groove is formed in an outer well portion of said fixing portion to a depth so as not to pass through an inner wall portion of the fixing portion, an O-ring is inserted between the fixing portion and an inner wall surface of the missile launch tube, and a fixing screw passing through the screw through hole is engaged in the screw groove.

4. The apparatus of claim 2, wherein said support portion of each of the fixing members includes:

a through hole and a washer insertion hole extending coaxially with the detaining groove;

a taper washer having a taper hole being inserted into the washer insertion hole;

an elastic portion formed in one end portion of the detaining screw and divided by a cut-away groove into which a detaining pin is inserted; and an engaging head portion formed on an end portion of the elastic portion and having a tapered slant guide surface coinciding with the taper hole.

5. The apparatus of claim 4, wherein said engaging head portion of the detaining screw includes:

a flat surface portion formed at both sides of the engaging head portion; and a release prevention plate formed at the rear portion of the support portion and having a release prevention groove with a straight line portion with respect to the flat surface portion.

6. The apparatus of claim 5, wherein said release prevention plate includes:

a circular-shaped elongated hole formed about the center of the detaining groove, for fixedly engaging the detaining screw passing through the circular-shaped elongated hole with the support portion.

7. The apparatus of claim 5, wherein said support portion includes a plurality of screw holes radially formed in a rear portion thereof arranged about the center of the detaining groove, to which the detaining screw for fixing the release prevention plate is selectively engaged.

8. The apparatus of claim 6, wherein said support portion includes a plurality of screw holes radially formed in a rear portion thereof with respect to the center of the detaining groove, to which the detaining screw for fixing the release prevention plate is selectively engaged.

9. The apparatus of claim 1, wherein said releasing rotation member includes:

a hinge portion hinged to the hinged portions of each of the fixing members; and an operating plate portion extending along the longitudinal axis of the missile from the hinged portion, wherein a fixing head portion having an engaging groove formed between a pair of engaging protrusions at the rear portion of the detaining pin, and a detaining pin fixing hole having an entrance portion of a diameter which is larger than that of the fixing head portion and a fixing portion having a width which is identical with the diameter of the engaging groove is formed at the operating plate portion.

10. The apparatus of claim 2, wherein said releasing rotation member includes:

a hinge portion hinged to the hinge portions of each of the fixing members, an operating plate portion extending coaxially with the longitudinal axis of the missile from the hinge portion, and a fixing head portion having an engaging groove being formed between a pair of engaging protrusions at the rear portion of the detaining pin, and a detaining pin fixing hole having an entrance portion of a diameter which is larger than that of the fixing head portion; and a fixing portion having a width which is identical with the diameter of the engaging groove is formed at the operating plate portion.

11. The apparatus of claim 9, wherein said apparatus further includes:

an elastic plate having a curved elastic contact portion fixed to the fixing head portion of each of the fixing members; and a detaining surface formed at the outer surface of the hinge portion of the releasing rotation member and selectively contacting with the elastic contact portion.

* * * * *